US005423698A

United States Patent [19]

Edgley et al.

[11] Patent Number: 5,423,698

[45] Date of Patent: Jun. 13, 1995

[54] ELECTRICAL CONNECTOR SYSTEM FOR A VIDEO DISPLAY TUBE YOKE

[75] Inventors: Richard R. Edgley, Elmhurst; William R. Lenz, Lockport; Daniel M. Palmieri, Bloomingdale, all of Ill.

[73] Assignee: Molex Incorporated, Lisle, Ill.

[21] Appl. No.: 220,083

[22] Filed: Mar. 30, 1994

[51] Int. Cl.[6] ..... H01R 13/502

[52] U.S. Cl. ..... 439/701; 439/441

[58] Field of Search ..... 439/166, 170, 171, 438, 439/441, 849, 818, 849, 695, 696, 701

[56] References Cited

U.S. PATENT DOCUMENTS

| | | | |
|---|---|---|---|
| 3,777,301 | 12/1973 | Michaels | 439/855 |
| 4,674,814 | 6/1987 | Hoshino et al. | 439/586 |
| 4,740,167 | 4/1988 | Millhimes et al. | 439/170 |
| 4,997,386 | 3/1991 | Kawachi et al. | 439/352 |
| 5,004,432 | 4/1991 | Tucker | 439/417 |
| 5,078,609 | 1/1992 | Bouchan et al. | 439/676 |
| 5,204,565 | 4/1993 | Sekine et al. | 439/855 |
| 5,269,699 | 12/1993 | Peloza | 439/849 |

FOREIGN PATENT DOCUMENTS

| | | | |
|---|---|---|---|
| 7611482 | 4/1976 | France | 439/849 |
| 2447755 | 10/1975 | Germany | 439/849 |
| 3526664 | 2/1986 | Germany | 439/695 |

OTHER PUBLICATIONS

A sketch of a connector offered for sale by Molex Incorporated prior to 1988.

A sketch of a plastic cover currently used on the existing video display tube yoke headers.

*Primary Examiner*—Larry I. Schwartz
*Assistant Examiner*—Jill DeMello
*Attorney, Agent, or Firm*—Stephen Z. Weiss

[57] ABSTRACT

An electrical connector system is provided for a video display tube yoke. The system includes a header mounted on the yoke and including a header body and a plurality of stiff terminal pins projecting from the body and terminated to appropriate leads from the yoke. A connector mates with the header and includes a dielectric housing having a plurality of terminal-receiving cavities and a plurality of pin-receiving passages communicating with the cavities. A plurality of terminals are received in the cavities. Each terminal includes a terminal portion adapted to be terminated to a wire conductor, and a trap portion aligned with one of the terminal-receiving passages. The trap portion is adapted to receive and trap one of the stiff terminal pins of the header. Latches are provided between the header and the connector to hold the connector in mated condition with the header.

6 Claims, 5 Drawing Sheets

14
16
58
22
20
18
22a
50
32
54
34
42
46
36
50
40
39
36
39
39a
38
39
39a
39
39a

ELECTRICAL CONNECTOR SYSTEM FOR A VIDEO DISPLAY TUBE YOKE

FIELD OF THE INVENTION

This invention generally relates to the art of electrical connectors and, particularly, to an electrical connector system located at the rear of a video display tube yoke.

BACKGROUND OF THE INVENTION

Video display tube yokes normally have some form of electrical connector, such as a header connector, mounted on the rear or back side of the yoke. The header has a plurality of relatively stiff terminal pins to which the conductors of a plurality of electrical wires are soldered, the wires providing electrical power to the yoke and/or the components thereof. A separate dielectric cover usually is mounted over the header connector, particularly over the terminal pins, to protect the pins and prevent engagement thereof with extraneous objects. The opposite ends of the wires often have one or more electrical connectors terminated thereto.

Therefore, with the current state of the art as described above, most video display tube yokes have a type of electrical harness "dangling" from the rear of the yoke and which continues to cause problems such as the harness catching on all kinds of extraneous objects during handling, assembly and the like. In addition, the solder connections of the wires to the header terminal pins on the yoke is labor intensive. The connectors attached to the free ends of the wires also add considerable expense to the overall apparatus. Still further, the separate cover is another cost item which would be desirable to have eliminated.

Attempts have been made to solve the above problems and avoid the disadvantages of current systems, but such attempts invariably have led to using non-conventional or different types or configurations of headers, or different types of terminals such as barrel-type pins, all of which involves considerable costs and such attempts have been inconsistent. The present invention is directed to solving these problems by an electrical connector system adapted for use with video display tube yoke header connectors of conventional design and configuration.

SUMMARY OF THE INVENTION

An object, therefore, of the invention is to provide a new and improved electrical connector system for a video display tube yoke.

In the exemplary embodiment of the invention, a header is mounted on the yoke and includes a header body and a plurality of stiff terminal pins projecting therefrom and terminated to appropriate leads from the yoke. A connector is provided for mating with the header and includes a dielectric housing having a plurality of terminal-receiving cavities. A plurality of pin-receiving passages communicate with the cavities. A plurality of terminals are received in the cavities. Each terminal includes a terminal portion adapted to be terminated to a wire conductor, and a trap portion aligned with one of the pin-receiving passages and adapted to receive and trap one of the stiff terminal pins of the header. A plurality of wire conductors are terminated to the terminals. Complementary interengaging latch means are provided between the header and the connector to hold the header in mated condition.

The connector also includes standoff means for engaging the header body to properly space the connector housing from the header body. As disclosed herein, the terminal portions of the terminals are provided by crimp sections for crimping termination to the wire conductors.

In one embodiment of the invention, the pin-receiving passages intersect the terminal-receiving cavities generally perpendicularly thereto to provide a right-angle connector configuration. In another embodiment of the invention, the pin-receiving passages intersect the terminal-receiving cavities generally parallel thereto to provide an in-line connector configuration.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
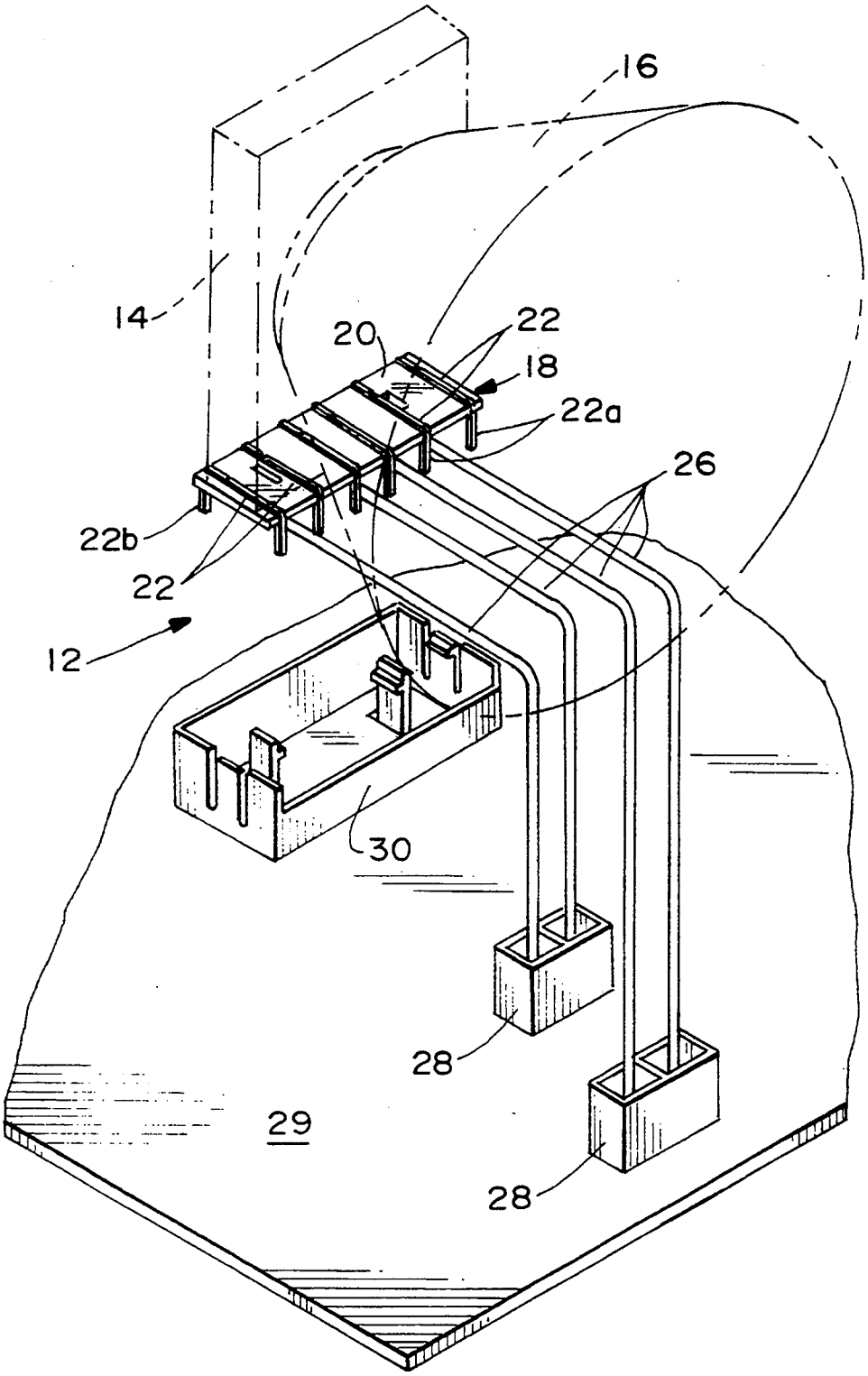
FIG. 1 (PRIOR ART)
FIG. 1 is a perspective view of a video display tube yoke incorporating an electrical connector system of the prior art.
Figure 9:
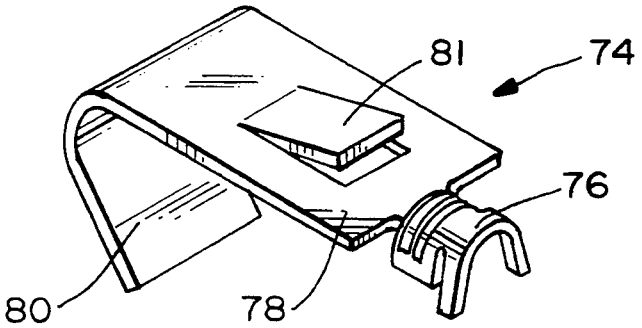
FIG. 9 is a perspective view similar to that of FIG. 7, but of a terminal used in an alternate embodiment of the invention.
Figure 10:
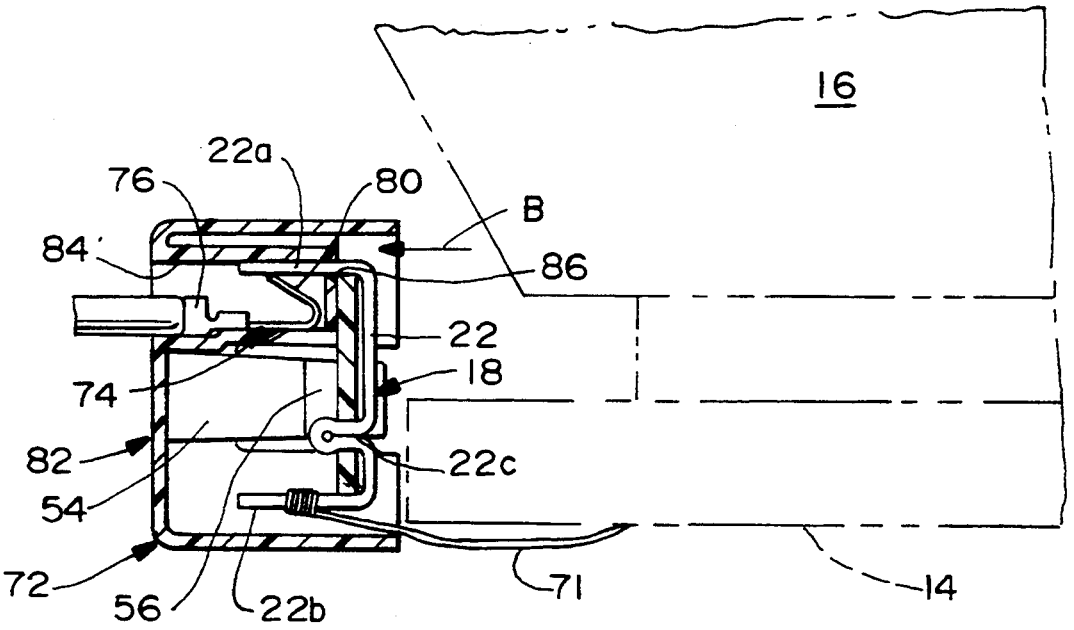
FIG. 10 is a side elevational view similar to that of FIG. 8, but of the alternate embodiment of the invention.

Referring to the drawings in greater detail, FIG. 1 shows a connector system for a video display tube yoke, according to the prior art. FIGS. 2–8 show one embodiment of an electrical connector system for a video display tube yoke, according to the invention. FIGS. 9 and 10 show a second embodiment of an electrical connector system for a video display tube yoke, according to the invention. Generally, the difference between the first embodiment of FIGS. 2–8 and the second embodiment of FIGS. 9 and 10, is that the first embodiment has a "right-angle" connector configuration, and the second embodiment has a "in-line" connector configuration, all of which will be apparent hereinafter.

More particularly, referring first to FIG. 1, an electrical connector system, generally designated 12, is shown according to the prior art as applied to a collar 14 at the rear of a video display tube yoke 16. The system includes a header connector, generally designated 18, which includes a generally flat dielectric body 20. A plurality of generally U-shaped terminals 22 are mounted on body 20, with leg portions 22*a* and 22*b* projecting along opposite side edges of the body and with loop portions 22*c* first passing through ;slots in body 20 and then expanded to hold the terminals 22 to body 20. Legs 22*a* and 22*b* form relatively stiff terminal pins of the header. Leads from the yoke are soldered to terminal pins 22*a*.

Connector system 12 of the prior art shown in FIG. 1, also includes a plurality of electrical wires 26 where each wire inner conductor is "hard-wired" or soldered to loop portions 22*c* of terminals 22. The opposite ends of the wires are terminated to one or more electrical connectors 28. These connectors mate with other connectors which may be surface mountable to a printed circuit board 29. Lastly, a separate cover 30 is mounted over header 18 to protect the header, particularly to protect and enclose terminal pins 22*a* and 22*b* along with their terminations to the yoke leads and conductors of wires 26.

From the foregoing, it can be understood from the description of the prior art connector system 12 in FIG. 1, that the hard-wired electrical harness including wire conductors of wires 26 and connectors 28 are permanent attachments to yoke 16. During handling and assembly procedures of the yoke, the "harness" has a tendency to become entangled with all kinds of extraneous objects. In addition, the solder connections of the system, along with separate connectors 28 and separate cover 30 are labor intensive and not very cost effective.

Figure 2:
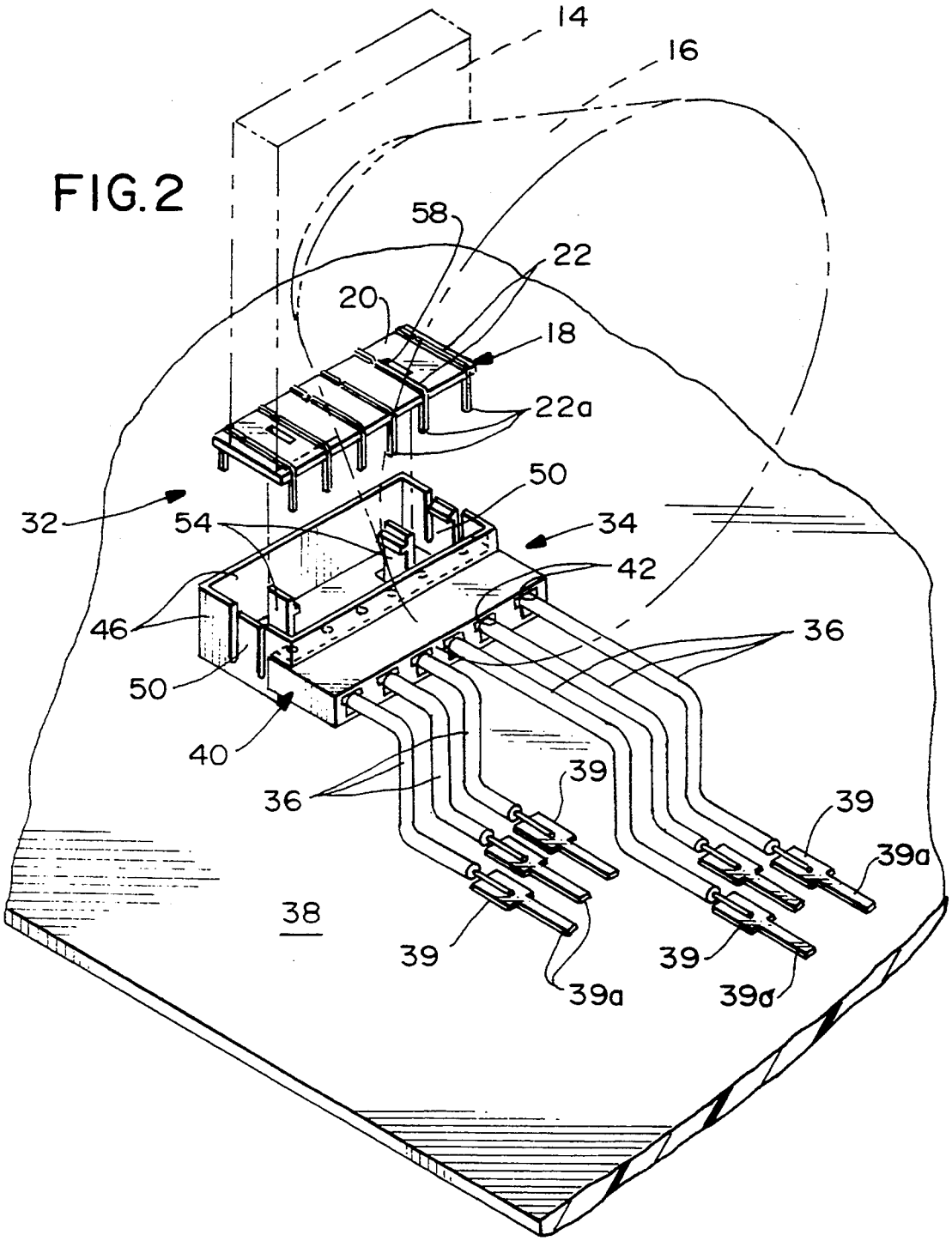
FIG. 2 is a perspective view of a video display tube yoke incorporating one embodiment of the electrical connector system of the invention.

FIG. 2 shows one embodiment of an electrical connector system, generally designated 32, according to the invention. The system does not make any modifications to header 18, including body 20, terminals 22, stiff terminal pins 22*a* and 22*b*, as well as the manner in which the leads from the yoke are soldered to legs 22*b* of the terminals.

Figure 3:
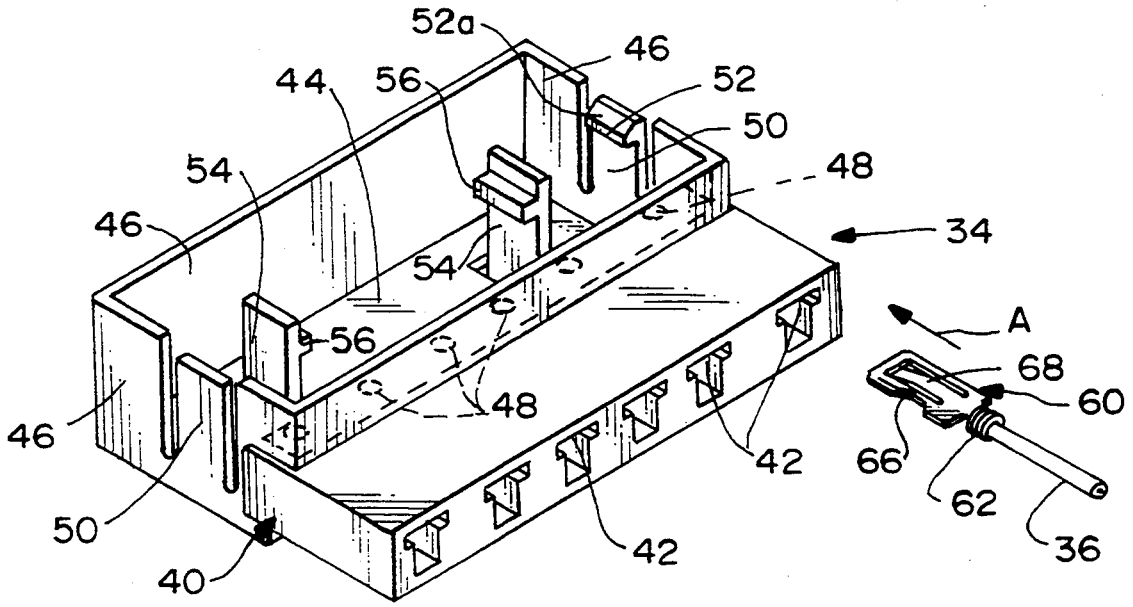
FIG. 3 is a perspective view of the connector of the system.

However, referring to FIG. 3 in conjunction with FIG. 2, the invention incorporates a connector, generally designated 34, for mating with header 18. A plurality of conductors of wires 36 leading from a printed circuit board 38 are terminated within connector 34, as will be described hereinafter. The conductors are connected to circuit traces 39*a* on the printed circuit board by being soldered to circuit pads 39 as shown in FIG. 2 or by being connected to terminals which mate with terminals mounted to the circuit pads 39 of the printed circuit board. With the connector being matable with header 18, it can be understood that yoke 16 can be handled and/or assembled without any harnesses dangling therefrom and which can become entangled or caught on extraneous objects.

Figure 4:
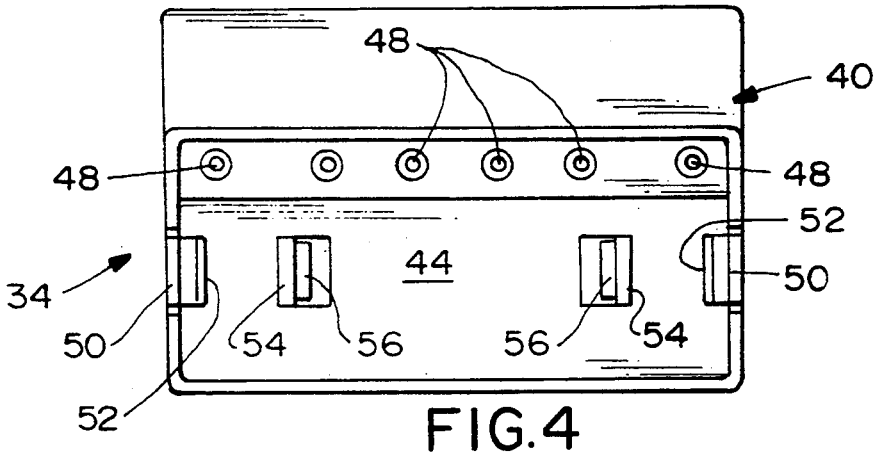
FIG. 4 is a top plan view of the connector.
Figure 5:
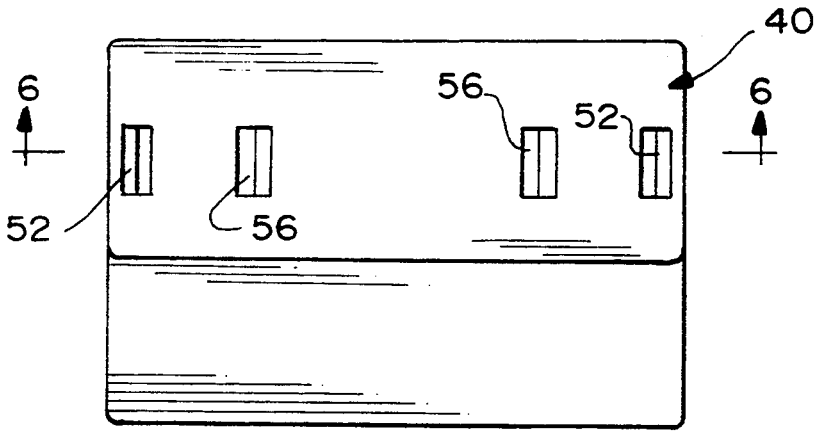
FIG. 5 is a bottom plan view of the connector.
Figure 6:
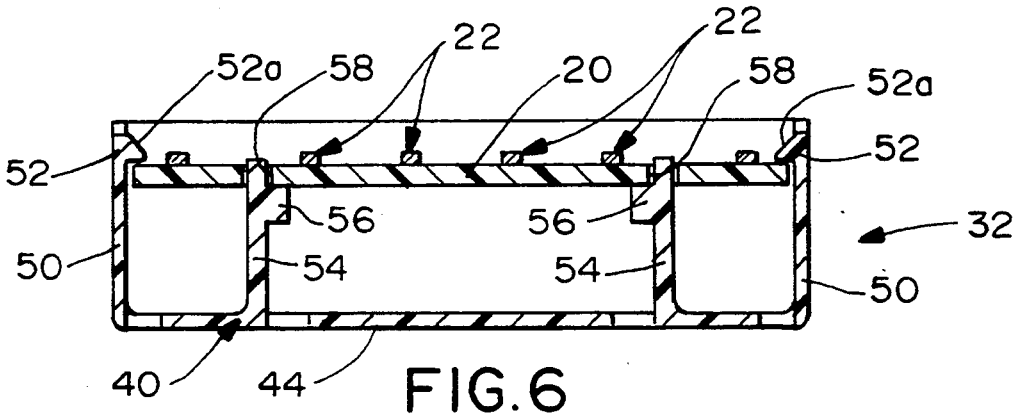
FIG. 6 is a section taken generally along line 6—6 of FIG. 5.

Referring to FIGS. 4–6 in conjunction with FIGS. 2 and 3, connector 34 includes a dielectric housing, generally designated 40, which includes a plurality of terminal-receiving cavities 42. The housing has a box-like section 44 having peripheral side flanges 46 which substantially embrace header 18 and particularly protect the stiff terminal pins 22*a* and 22*b* of the header. Housing 40 further includes a plurality of pin-receiving passages 48 which are in communication with terminal-receiving cavities 42. In the embodiment of FIGS. 2–8, as stated above, connector 34 provides a "right-angle" connector configuration. In essence, pin-receiving passages 48 extend through housing 40 and intersect terminal-receiving cavities 42 generally perpendicularly thereto to provide the right-angle connector configuration.

As best seen in FIG. 6, connector housing 40 includes a pair of latch arms 50 having hooked distal ends 52. Preferably the entire housing is unitarily molded in one-piece of dielectric material such as plastic or the like. Therefore, latch arms 50 are inherently flexible. When connector 40 is mated with header 18, chamfered surfaces 52*a* on hooked distal ends 52 of the latch arms bias the arms outwardly until the hooked distal ends snap beneath header body 20.

Lastly, and still referring to FIG. 6, a pair of flanges 54 project inwardly within the box-like section 44 of connector housing 40. The flanges have integral abutment bosses 56 on the insides thereof. The distal ends of the flanges project into holes 58 in header body 20, and abutment bosses 56 abut against the top surface of the header body to provide "standoff" means to properly space the connector housing from the connector body when hooked distal ends 52 of latch arms 50 snappingly mate connector 40 with header 18.

Figure 7:
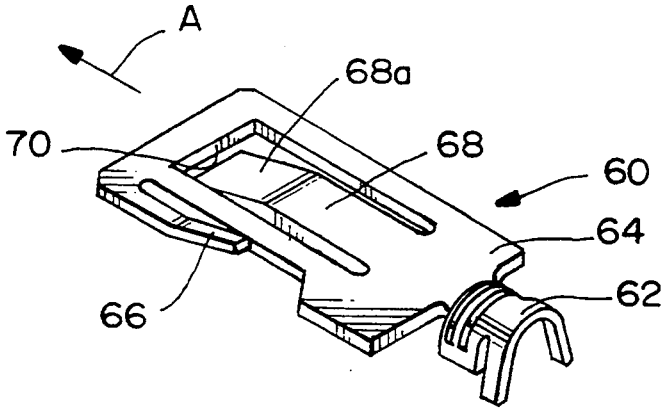
FIG. 7 is a perspective view, on an enlarged scale, of one of the connector terminals.

Referring to FIG. 7, a plurality of terminals, generally designated 60, are received within terminal-receiving cavities 42 of connector housing 40. Each terminal includes a terminal portion 62 adapted to be terminated to a respective wire conductor 36. In the embodiment illustrated, the terminal portion is a crimp section adapted to be crimped onto the inner conductor of an electrical wire. The terminal also includes a blade section 64 which is the section of the terminal that is inserted into a respective one of the terminal-receiving cavities 42. The terminal may be stamped and formed of sheet metal material, with blade section 64 being generally planar. A latch tongue 66 is formed out of the blade section and faces or "points" in a direction opposite the insertion direction of the terminal as indicated by arrow "A". Once inserted into its respective terminal-receiving cavity, the terminal is precluded from being pulled out of the cavity by latch tongue 66 which will dig into the plastic material of the connector housing upon the application of forces on the terminal opposite the insertion direction of arrow "A".

Each terminal 60 includes a trap portion in the form of a trap tongue 68 which is formed out of planar blade section 64. When the terminal is fully inserted into 10 a respective one of the terminal-receiving cavities 42, a bent distal end 68*a* of trap tongue 68 is aligned with a respective pin-receiving passage 48. Upon mating, stiff terminal pins 22*a* of header 18 move into cut-out areas 70 of terminals 60 and become trapped by ends 68*a* of trap tongues 68.

Figure 8:
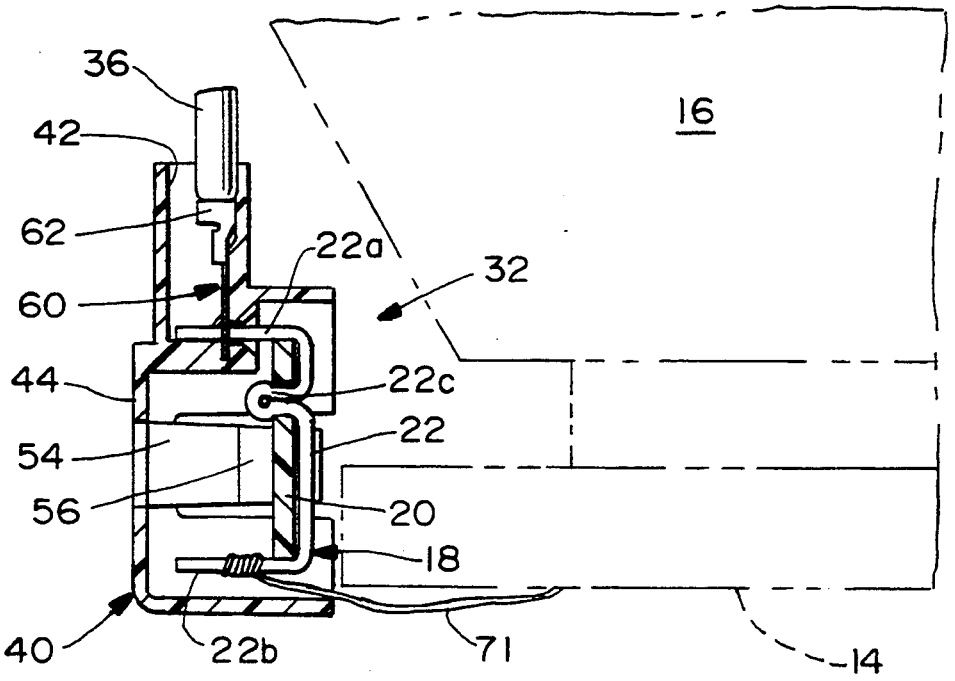
FIG. 8 is a side elevational view of the connector mated with the header on the video display tube yoke.

FIG. 8 shows that terminals 22 are secured to header body 20 by means of loop portions 22*c* secured within appropriate slots in the body. Leads 71 are also shown from the video display tube yoke hard wired to terminal pins 22*b*.

FIGS. 9 and 10 show an alternate embodiment of the invention wherein an "in-line" connector, generally designated 72, is adapted for mating with header 18. In-line connector 72 includes a plurality of in-line terminals, generally designated 74. Again, the terminal includes a crimp-type terminal portion 76 and a trap portion 78. A respective one of the stiff terminal pins 22*a* of header 18 is inserted into terminal 74 (FIG. 9) in the direction of arrow "B" (FIG. 10). The pin becomes trapped behind a trap tongue 80. A latch tongue 81 secures the terminal within the connector.

FIG. 10 shows that connector 72 again has a dielectric housing, generally designated 82, which includes a plurality of terminal-receiving cavities 84 for receiving terminals 74. With connector 72, a plurality of pin-receiving passages 86 are generally parallel to terminal-receiving cavities 84 to provide an in-line connector configuration. The connector housing has latch means and standoff means as described above in relation to the embodiment of FIGS. 2–8.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector system for a video display tube yoke, comprising:

a header mounted on the yoke and including a generally flat rectangular dielectric header body and a plurality of stiff terminal pins projecting from one surface of said header body and terminated to appropriate leads from the yoke;

a connector for mating with the header and including a dielectric housing having a plurality of terminal-receiving cavities, a plurality of pin-receiving passages communicating with the cavities, and stand off means for engaging said one surface of said header body to properly space said connector housing from said header body, said housing adapted to form a generally enclosed thin walled chamber with said header body so that anything projecting from said one header body surface may be protected, a plurality of terminals received in said cavities, each terminal including a terminal portion adapted to be terminated to a wire conductor and a trap portion aligned with one of the pin-receiving passages and adapted to receive and trap one of the stiff terminal pins of the header;

a plurality of wire conductors terminated to said terminals said housing adapted to allow each one of said wire conductors to pass through one of said terminal receiving cavities; and complementary interengaging latch means between the header and the connector to hold the connector in mated condition with the header.

2. The electrical connector system of claim 1 wherein said pin-receiving passages intersect the terminal-receiving cavities generally perpendicularly thereto to provide a right-angle connector configuration.

3. The electrical connector system of claim 1 wherein said pin-receiving passages intersect the terminal-receiving cavities generally parallel thereto to provide an in-line connector configuration.

4. The electrical connector system of claim 1 wherein said terminal portion of each terminal comprises a crimp section for crimping onto the wire conductor.

5. An electrical connector system for a video display tube yoke, comprising:

a header mounted on the yoke and including a generally flat rectangular dielectric header body and a plurality of stiff terminal pins projecting from one surface of said header body and terminated to appropriate leads from the yoke;

a connector for mating with the header and including a dielectric housing having a plurality of terminal-receiving cavities, a plurality of pin-receiving passages communicating with the cavities, said pin-receiving passages intersecting the terminal-receiving cavities generally perpendicular thereto to provide a right-angle connector configuration, and stand off means for engaging said one surface of said header body to properly space said connector housing from said header body, said housing adapted to form a generally enclosed thin walled chamber with said header so that anything projecting from said one header body surface may be protected;

a plurality of terminals received in said cavities, each terminal including a terminal portion adapted to be terminated to a wire conductor and a trap portion aligned with one of the pin-receiving passages and adapted to receive and trap one of the stiff terminal pins of the header and said housing adapted to allow each one of said wire conductors to pass through one of said terminal receiving cavities.

6. The electrical connector system of claim 5, including a plurality of wire conductors terminated to said terminals.

* * * * *